US006047144A

United States Patent [19]

Sasai et al.

[11] Patent Number: 6,047,144

[45] Date of Patent: Apr. 4, 2000

[54] IMAGE FORMING DEVICE

[75] Inventors: Takahiro Sasai, Kyoto; Akinori Nishizawa, Uji, both of Japan

[73] Assignee: Murata Kikai Kabushiki Kaisha, Kyoto, Japan

[21] Appl. No.: 09/293,696

[22] Filed: Apr. 16, 1999

[30] Foreign Application Priority Data

Apr. 20, 1998 [JP] Japan ..... 10-125238
Apr. 27, 1998 [JP] Japan ..... 10-116808

[51] Int. Cl.[7] ..... G03G 15/00

[52] U.S. Cl. ..... 399/44; 399/297

[58] Field of Search ..... 399/43, 44, 66, 399/94, 97, 45, 101, 297

[56] References Cited

U.S. PATENT DOCUMENTS

| | | | |
|---|---|---|---|
| 4,912,515 | 3/1990 | Amemiya et al. | 399/66 |
| 5,119,141 | 6/1992 | Bhagat . | |
| 5,128,717 | 7/1992 | Uchikawa et al. | 399/66 |
| 5,151,736 | 9/1992 | Ohzeki et al. . | |
| 5,276,483 | 1/1994 | Hasegawa et al. | 399/66 |
| 5,287,144 | 2/1994 | Takeda | 399/66 |
| 5,621,504 | 4/1997 | Wakamatsu et al. . | |
| 5,682,575 | 10/1997 | Komori | 399/66 |
| 5,822,651 | 10/1998 | Yim et al. | 399/66 |

FOREIGN PATENT DOCUMENTS

| | | | |
|---|---|---|---|
| 0 367 245 | 5/1990 | European Pat. Off. . | |
| 4-0143773 | 5/1990 | Japan . | |
| 4-280279A | 10/1992 | Japan | G03G 15/16 |
| 5-181373 | 7/1993 | Japan | G03G 15/00 |
| 6-308844 | 4/1994 | Japan . | |
| 6-138783 | 5/1994 | Japan . | |
| 06308844A | 11/1994 | Japan | G03G 15/16 |
| 07064411A | 3/1995 | Japan | G03G 15/16 |
| 8-240958 | 9/1996 | Japan . | |

*Primary Examiner*—Arthur T. Grimley
*Assistant Examiner*—Hoang Ngo
*Attorney, Agent, or Firm*—Loeb & Loeb, LLP

[57] ABSTRACT

A toner image formed on the photosensitive body (21) is transferred to printing paper by applying a voltage from a transfer roller (25) in an image transfer section of an image forming device (1). The transfer roller (25) is provided with a transfer voltage generating circuit (31) connected to a control unit (30). Information about an optimum transfer voltage is gathered from a look-up table (34) provided in a memory (33), in accordance with environmental conditions such as temperature and humidity in the device (1) which are detected by a sensor (35). The voltage to be applied to the transfer roller (25) is determined by the control unit (30). The voltage applied to the transfer roller between sheets of printing paper is also changed in accordance with the detected environmental conditions.

16 Claims, 5 Drawing Sheets

IMAGE FORMING DEVICE

BACKGROUND OF THE INVENTION

1. Field of the Invention

The present invention relates to an image forming device using a transfer roller in order to transfer a toner image formed on a photosensitive body onto paper, and more particularly to such an image forming device equipped with means for controlling the voltage applied to the transfer roller.

2. Description of the Related Art

An image forming device using a general electrophotographic method generally includes a charger for creating a uniform electrical charge on a belt-shaped or drum-shaped photosensitive body, an exposing unit for forming an electrostatic latent image by irradiating light onto the surface of the photosensitive body, a developer for causing toner to adhere to the electrostatic latent image, thereby forming a toner image, and a transfer unit for transferring the toner image formed on the photosensitive body onto paper. The transfer unit is generally a transfer roller. In the developer, there are provided an agitator for agitating the toner inside a toner vessel whilst feeding said toner forwards, and a developing roller for supplying the toner to the photosensitive body. Furthermore, the developing roller is constituted such that a thin layer of toner is formed on the surface of the roller by applying pressure by means of a blade, thereby ensuring that the operation of supplying the toner to the electrostatic latent image formed on the photosensitive body is carried out in a satisfactory manner.

Thereupon, a toner image is formed by causing the toner to adhere to the electrostatic latent image formed on the photosensitive body, and this toner image is transferred to the paper. In the general image forming device described above, means for creating a corona discharge is used for transferring the toner image from the photosensitive body onto the paper, but since the production of ozone is worried about, in many cases, devices are constructed to include a transfer roller which avoids generation of ozone. The transfer roller may include a metal roller shaft and an electrically conductive rubber or plastic layer of a prescribed thickness provided on the shaft. Transfer of a toner image similar to that achieved by a corona discharge is carried out by applying a voltage of a prescribed value to the electrically conductive roller shaft. Since the image forming device produces no ozone due to adoption of the transfer roller, a merit is obtained in that the mechanism for processing exhaust gas from the device can be simplified, and moreover, it is possible to prevent adverse effects on the indoor environment.

In the image transfer means employing the transfer roller, the voltage applied to the transfer roller has a slight effect on the performance of transferring the toner image from the photosensitive body to the printing paper. Therefore, when starting a printing operation, a test voltage is applied in advance, and the transfer voltage is set according to information on the variations in this voltage. However, in cases where a large quantity of printing paper is used consecutively, the temperature inside the device rises as the work progresses, and therefore problems will arise in that the optimum transfer voltage will shift as this temperature increases, and it will not be possible satisfactorily to ensure printing quality. If the initial voltage setting is increased in order to cope with situations where the temperature rises, another problem will then arise in that the photosensitive body and the transfer roller will deteriorate rapidly due to the fact that a higher voltage than required is being applied thereto.

On the other hand, when setting the value of the transfer voltage applied to the transfer roller, the environmental temperature is also taken into account as a control condition, and therefore, within a certain temperature range, the relationship between the current detected when a test voltage is applied and the transfer voltage is determined in accordance with control conditions set in a look-up table in the control unit. However, a problem arises in that in the border regions of the adjacent temperature ranges set in the respective look-up tables, in some cases the transfer voltages do not match and vary considerably with slight change of temperature.

If plural sheets of printing paper are used in a consecutive manner, the transfer roller will continue to rotate in a state of contact with the photosensitive body, even between sheets of paper, and the voltage of a prescribed value will remain applied to the transfer roller. Therefore, in a state where the transfer roller is in contact with the photosensitive body without the printing paper being nipped therebetween, the voltage on the transfer roller acts directly on the photosensitive body, and hence local variations in electric potential may arise on the surface of the photosensitive body, thereby leading to the occurrence of faults in image quality. It can be seen that problems of this kind are especially liable to occur when a higher voltage than required is applied to the transfer roller.

SUMMARY OF THE INVENTION

The present invention resolves the problems relating to the conditions of applying a voltage to the transfer roller. An object of the present invention is therefore to provide an image forming device which can regulate the value of the voltage applied to the transfer roller in such a manner that no sudden voltage changes occur in the border regions of the adjacent temperature ranges memorized in the respective look-up tables.

It is a further object of the present invention to provide an image forming device which enables an optimum voltage to be applied to the transfer roller in response to changes in the temperature environment of the device.

The present invention generally relates to an image forming device including a photosensitive body, means for applying a uniform electrical charge to the photosensitive body, means for forming a latent electrostatic image onto the photosensitive body, developing means, and transferring means.

An image forming device according to a first aspect of the present invention is characterized in that it further includes detecting means for applying a test voltage to the transferring means between sheets of printing paper, and detecting the transfer environment, and control is implemented whereby the voltage applied when transferring a toner image to printing paper is redetermined in accordance with the value detected by the detecting means.

A test voltage may be applied to the transferring means and the transfer voltage may be redetermined, after a prescribed number of printing media have been printed.

The image forming device may further include temperature detecting means, and the transfer voltage may be redetermined on the basis of the detected temperature value and the current detection value when a test voltage is applied. A plurality of tables specifying relationships between detected temperatures and transfer voltages may be previously stored in a memory of a control unit for a plurality of temperature ranges respectively, and control may be implemented for harmonizing transfer voltages in boundary regions between the adjacent temperature ranges in the tables.

By adopting the composition described above, the image forming device according to the present invention is able to maintain uniform printing quality by applying a test voltage and controlling the transfer voltage, each time a prescribed number of sheets has been printed, and furthermore, it is possible to prevent a higher voltage than necessary from being applied to the transfer roller and the photosensitive body, and in turn to prevent damage being caused to the photosensitive body, or the like. Moreover, in the image forming device according to the present invention, when determining the transfer voltage, it is possible to achieve smooth change in control voltage with respect to change in temperature, whilst eliminating sudden voltage changes in the border temperature regions of the control tables, thereby making it possible to prevent changes in printing quality.

According to another aspect of the present invention, there is provided an image forming device comprising a photosensitive body, an electric charger for applying a uniform electrical charge to the photosensitive body, an exposing unit for forming a latent electrostatic image onto the photosensitive body, a developing unit, a transfer unit having a transfer roller, temperature detecting means for detecting the environmental temperature of the device, and transfer voltage controlling means for determining the voltage applied to the transfer roller between printing media, on the basis of the temperature detected by the temperature detecting means.

The image forming device may further include temperature change detecting means for detecting changes in the temperature of the device after an operation of transferring images has started, and the transfer voltage controlling means may adjust the voltage applied to the transfer roller on the basis of the output from the temperature change detecting means.

The transfer voltage controlling means may adjust the voltage applied to the transfer roller on the basis of a table previously formulated in a control unit.

The image forming device is able to adjust the voltage applied to the transfer roller to an optimum value, during an operation of printing a large number of sheets, thereby making it possible to maintain uniform printing quality. Moreover, since there are no instances of a greater current than necessary flowing to the transfer roller or photosensitive body, deterioration of these members is suppressed, and significant change does not occur in the surface electric potential of the photosensitive body between sheets thereby making it possible to maintain uniform image quality.

DETAILED DESCRIPTION OF THE INVENTION

Figure 1:
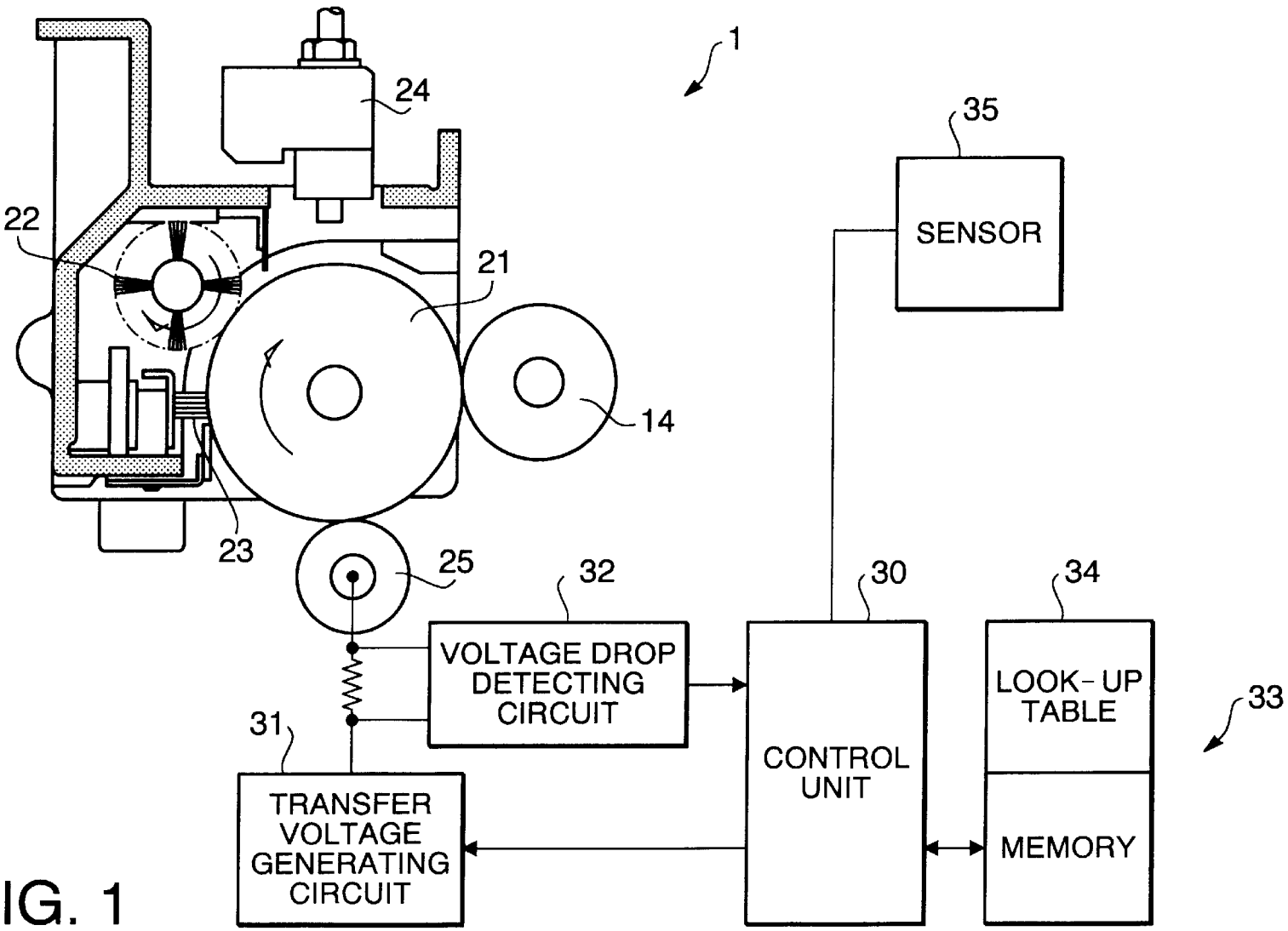
FIG. 1 is an illustrative diagram of an embodiment of the present invention.

The composition of the device according to the present invention is now described with reference to illustrated examples. FIG. 1 illustrates some of major elements of an image forming device 1 and shows particularly the relationship between a photosensitive body 21, a developing roller 14 and a transfer roller 25, all of which are located in the image forming section of the image forming device 1. In the photosensitive body unit, which is provided detachably as a single unit in the main body of the image forming device 1, a memory removing brush 23 and a charging roller 22 are positioned with respect to the photosensitive body 21, and the transfer roller 25 is located in the image transfer section. A writing unit 24 and a developing roller 14 of a developing unit are positioned with respect to the photosensitive body 21. After the charging roller 22 has applied a uniform charge to the photosensitive body 21, the writing unit 24 forms a latent electrostatic image by irradiating light representing an image onto the photosensitive body 21, and the developing roller 14 supplies toner onto the latent electrostatic image, thereby forming a toner image on the photosensitive body 21. When printing paper is conveyed to the image transfer section in such a manner that it is nipped between the photosensitive body 21 and the transfer roller 25, the toner image formed on the photosensitive body 21 is transferred from the photosensitive body 21 to the printing paper by applying a voltage of a prescribed value to the transfer roller 25.

The transfer voltage applied to the transfer roller 25 is generated by a transfer voltage generating circuit 31 and the value of this voltage is set by a control unit 30. This control unit 30 makes use of information from a sensor 35 which serves as detecting means for obtaining information on the temperature and/or humidity inside the device 1, and information from a voltage drop detecting circuit 32 for detecting variations in the voltage applied to the transfer roller. The control unit 30 determines the value of the inflow current flowing from the transfer roller to the photosensitive body when the test voltage is applied on the basis of information from the voltage drop detecting circuit 32. The sensor 35 which provides an input to the control circuit 30 can be located in any position in the image forming device 1 as long as it is able to detect changes in the average temperature inside the image forming device 1 or average change in the temperature inside the image forming device 1. Moreover, a memory 33 is connected to the control circuit 30, and control information is determined and output from the control circuit 30 to the transfer voltage generating circuit 31 in accordance with control data contained in look-up tables 34 stored in the memory 33.

Figure 2:
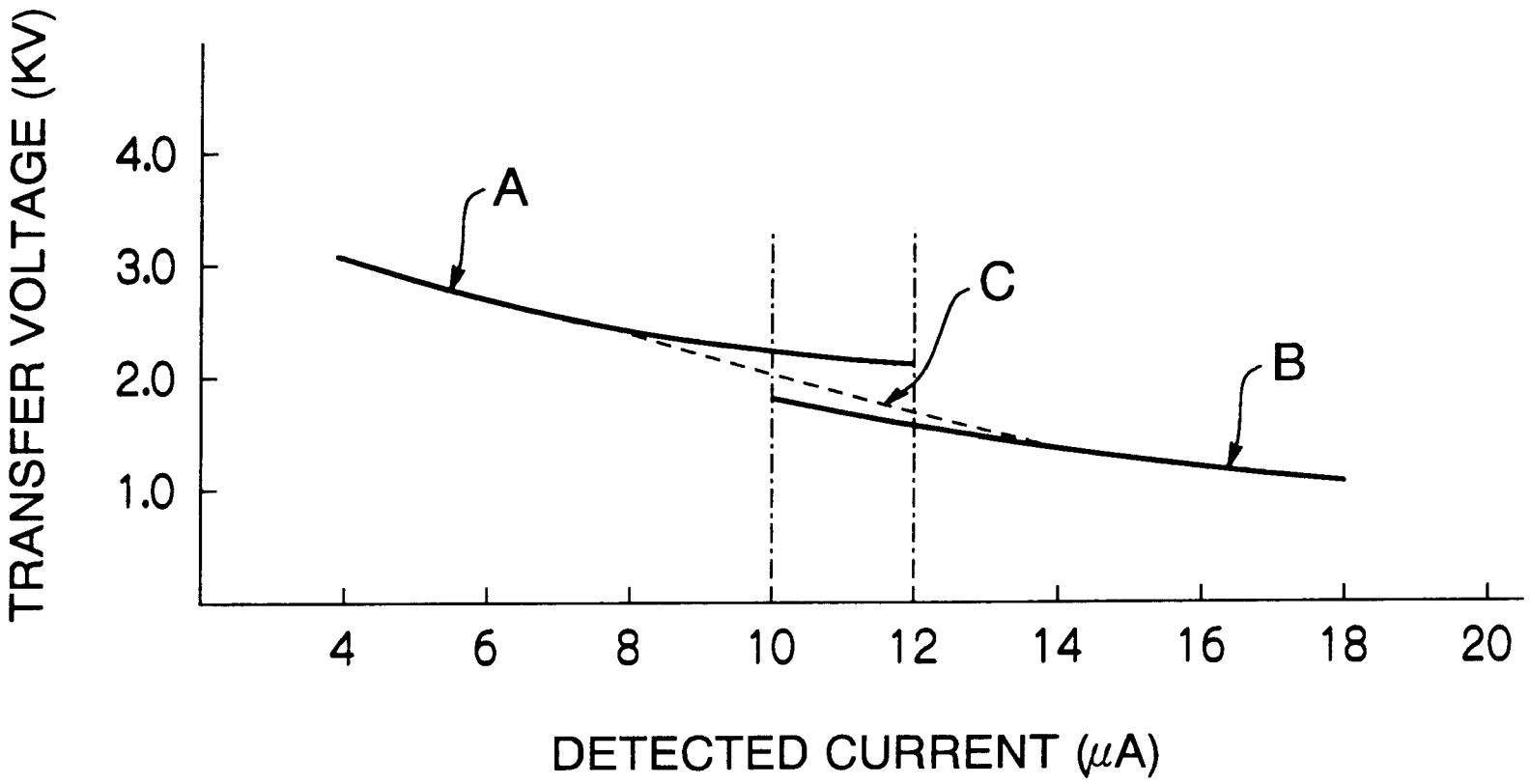
FIG. 2 is a graph showing the relationship between temperature and transfer voltage.

As illustrated by the graph in FIG. 2, there are two look-up tables 34 in the memory 33 which contain data represented by the curve A showing the relationship between the detected current and applied voltage when the temperature is equal to or less than 20° C., and the curve B showing the relationship between the detected current and applied voltage when the temperature is equal to or over 20° C. The above described control conditions are determined according to these curves A and B. However, there is a large discrepancy between the curves A and B in the control value for a temperature of 20° C., and consequently the voltage value changes significantly at the point where the temperature detected by the temperature sensor moves above 20° C. Therefore, in the present embodiment, the two curves A, B for control conditions at different temperatures are connected together by the control curve C. The third curve C is previously stored in another look-up table 34, and control is implemented in such a manner that no large change in voltage occurs when the temperature data detected by the sensor moves from one table (e.g., that for the curve A) set as fundamental control data to the other table (e.g., that for the curve B).

Employing the curve C or similar control curve in the above described manner as one of the control conditions to be provided in the memory of the control device is arbitrarily possible. For example, it is applicable to the image forming device 1 shown in FIG. 1. If the image forming device 1 is equipped with a transfer roller positioned in contact with a photosensitive body, two curves such as those A and B shown in FIG. 2 which indicate the relationship between the detected current and application voltage for different ranges of temperature are first prepared in accordance with the characteristics of the transfer roller and photosensitive body, and then a transitional curve (e.g., curve C in FIG. 2) is created to smoothly connect the two curves in the overlapping border regions of the neighboring control ranges. Therefore, no sudden changes occur in voltage with respect to temperature change and hence there are no instances of a higher voltage than required being applied to the member(s) concerned.

In a device where control tables such as that shown in FIG. 2 are set, when control of the transfer voltage is implemented, the transfer voltage generating circuit 31 supplies a test voltage of a prescribed value upon inputting of a printing job start signal to the control unit. The control unit then determines the load by monitoring the inflow current relating to this voltage by means of the voltage drop detecting circuit 32. The control unit also sets an optimized transfer voltage value on the basis of this load value, in accordance with temperature information from the sensor 35. The value of the transfer voltage specified initially must be set to be high if the environmental temperature (temperature in the image forming device 1) is low and it can be set to be low if the environmental temperature is high.

In this embodiment, after setting an initial transfer voltage as described above, a test voltage is applied and the load is measured again each time 20 sheets of paper have been printed, for example, and the transfer voltage is modified by taking into account the measurement values and temperature conditions. In this case, it is difficult to obtain an accurate measurement value in a short period of time between sheets of printing paper that are conveyed in a continuous fashion, and therefore, feed of the printing paper is halted for 2–3 seconds, for example, and a test voltage is applied in a state where no printing paper is present between the photosensitive body and the transfer roller. After the test voltage has been measured between sheets of paper, the control unit selects optimum control values set in the control tables of the memory by using the temperature detection values from the sensor and the data on changes in inflow current, and the voltage thus determined is supplied via the transfer voltage generating circuit 31 to the transfer roller 25. Next, when further 20 sheets of printing paper have been printed in the same job, the operations of applying a test voltage and setting a new optimum transfer voltage are repeated once again. Moreover, when a job has finished and the next printing job is to be carried out, the tasks of setting an initial transfer voltage and modifying the transfer voltage during the job are implemented in the manner described above.

Figure 3:
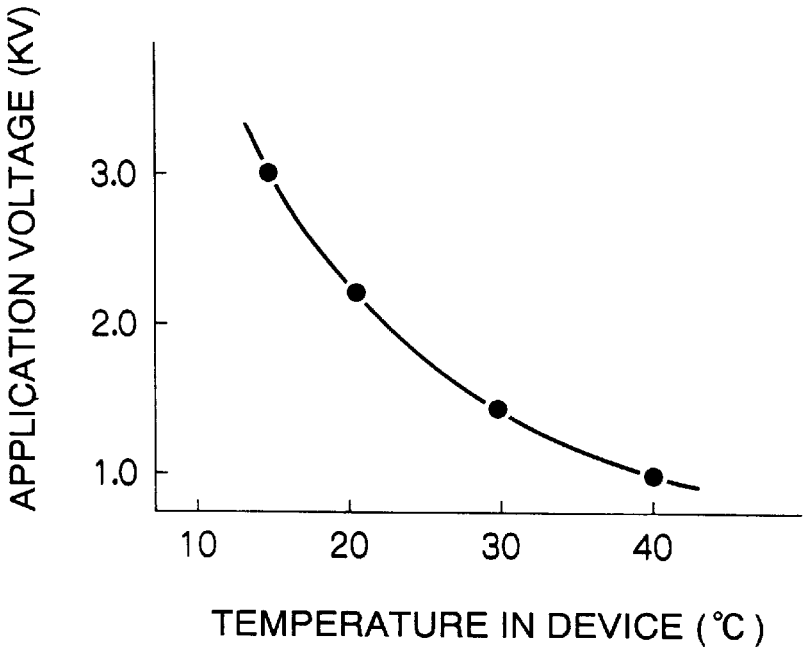
FIG. 3 is a graph showing the relationship between temperature and applied voltage.
Figure 4:
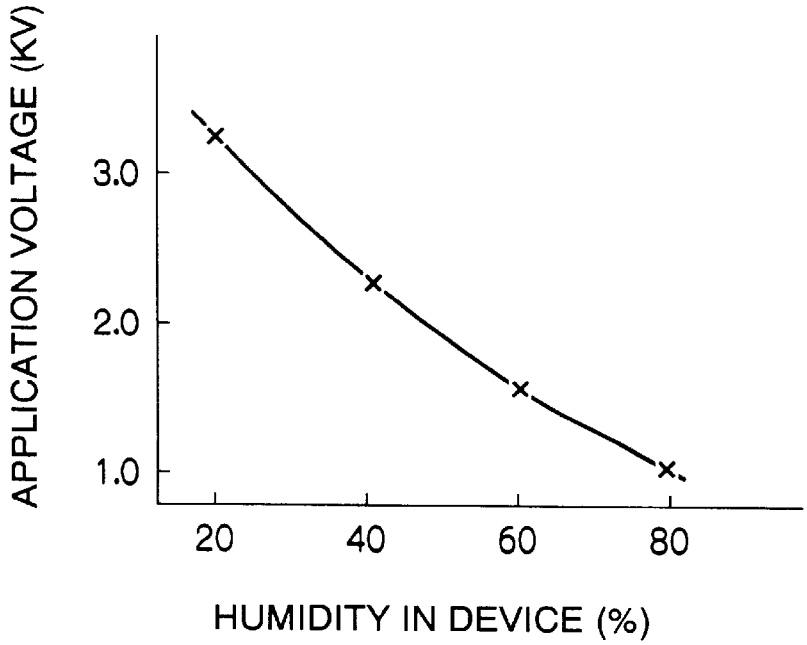
FIG. 4 is a graph showing the relationship between humidity and applied voltage.

In an image forming device using a general transfer roller, the relationship between the environmental temperature and the transfer voltage is like that illustrated by the graph in FIG. 3, and if the environmental temperature (internal device temperature) is low, then it is necessary to set a high value for the applied voltage, whereas if the temperature is high, then a low applied voltage can be set. Moreover, a relationship as illustrated by the graph in FIG. 4 exists between the internal humidity of the device and the optimum applied voltage. Therefore, in the present invention, the relationship between the temperature (humidity) and applied voltage illustrated by the graph in FIG. 3 and/or FIG. 4 is set in the look-up tables in the memory, in such a manner that optimum voltage application can be implemented on the basis of data obtained by measuring the environmental conditions inside the device by means of the sensor 35.

It is possible to use any of the following control methods for transferring the control information from the control unit 30 to the transfer voltage generating circuit 31.

1. The transfer voltage is modified by measuring change in temperature during a job.

In other words, when a large volume of printing is carried out continuously in a single job, the internal temperature of the device rises under the effect of heat from the fixing unit, and the like, and the optimum transfer voltage changes greatly with this temperature rise, as shown by the graph in FIG. 3. For example, assuming that the internal device temperature has risen from 20° C. to 40° C., the optimum transfer voltage will decline significantly from 2.3 kV to 1.0 kV. Therefore, the control unit as illustrated in FIG. 1 gathers information from the sensor 35 when a certain number of paper sheets have been printed during a single job, extracts from the look-up tables 34 information on the optimum control temperature corresponding to the signal from this sensor, and changes (or adjusts) the transfer voltage to a value set in the look-up tables. Thereupon, after N sheets have been printed, a signal is gathered from the sensor, similarly, and control is implemented whereby the voltage information output from the control unit to the transfer voltage generating circuit is rewritten.

2. The transfer voltage can also be modified by measuring change in humidity during a job.

In other words, when a large volume of printing is carried out continuously in a single job, the internal device temperature rises under the effect of heat from the fixing unit, and the like, and the environmental humidity also changes significantly. If information on humidity is used, data such as that illustrated by the graph in FIG. 4 is set in the look-up tables, and a transfer voltage corresponding to the measured humidity is selected.

3. The transfer voltage can also be modified by measuring change in the temperature and humidity during a job.

In this case, data like that shown by the graphs in FIGS. 3 and 4 is set in the look-up tables, and suitable factors are set for respective temperature and humidity values. A voltage is then set for the transfer voltage generating circuit by using the measured values of temperature and humidity, and the factors for the temperature and humidity values.

If the control data is modified whilst printing is being carried out using the environmental temperature (and/or humidity data) as described above, then when the user initially turns on the switch of the image forming device, the control unit gathers measurement data from the sensor, and sets an initial transfer voltage for the transfer roller. Thereupon, the control unit occasionally detects subsequent change in the environment by means of the sensor, and it modifies the control conditions using measurement data for the temperature (or humidity, or both temperature and humidity) during the task in question. When the control unit implements an operation of modifying the control conditions, the measurement value for the condition of the photosensitive body as obtained from the voltage drop detecting circuit 32 may also be used as modification information by the control circuit. Consequently, rather than relying simply on the temperature or humidity conditions, in cases where the measurement value in the voltage drop detecting circuit is different from the initial set value for the device, the control unit will update the transfer voltage applied to the transfer roller by setting control conditions which incorporate respective measurement data.

4. The transfer voltage is modified between paper sheets in response to change in the environmental temperature.

When a large number of sheets of paper are printed continuously in a single job, a voltage of a uniform value remains applied to the transfer roller even between printing sheets, which are supplied in a continuous fashion from the photosensitive body to the image transfer section. However, if the environmental conditions change, then the voltage applied to the transfer roller diverges from the optimum value, and this may cause significant fluctuations in the electric potential on the surface of the photosensitive body. Therefore, tables indicating temperatures and corresponding voltages to be applied between sheets are previously stored in the memory of the control unit, and a temperature signal is obtained from the sensor at prescribed timings during the job. The control unit sets a between-sheet voltage value that is optimum with respect to these environmental temperature conditions, and it controls the transfer voltage generating circuit in such a manner that the optimum between-sheet voltage is applied at a timing where the transfer roller between sheets is in direct contact with the photosensitive body. When control of this kind is implemented, in transferring the toner image to the printing paper, the optimum applied voltage value is applied to the transfer roller is the same manner as that described above. In this embodiment also, the data obtained from the sensors may be temperature or humidity data or both.

Figure 5:
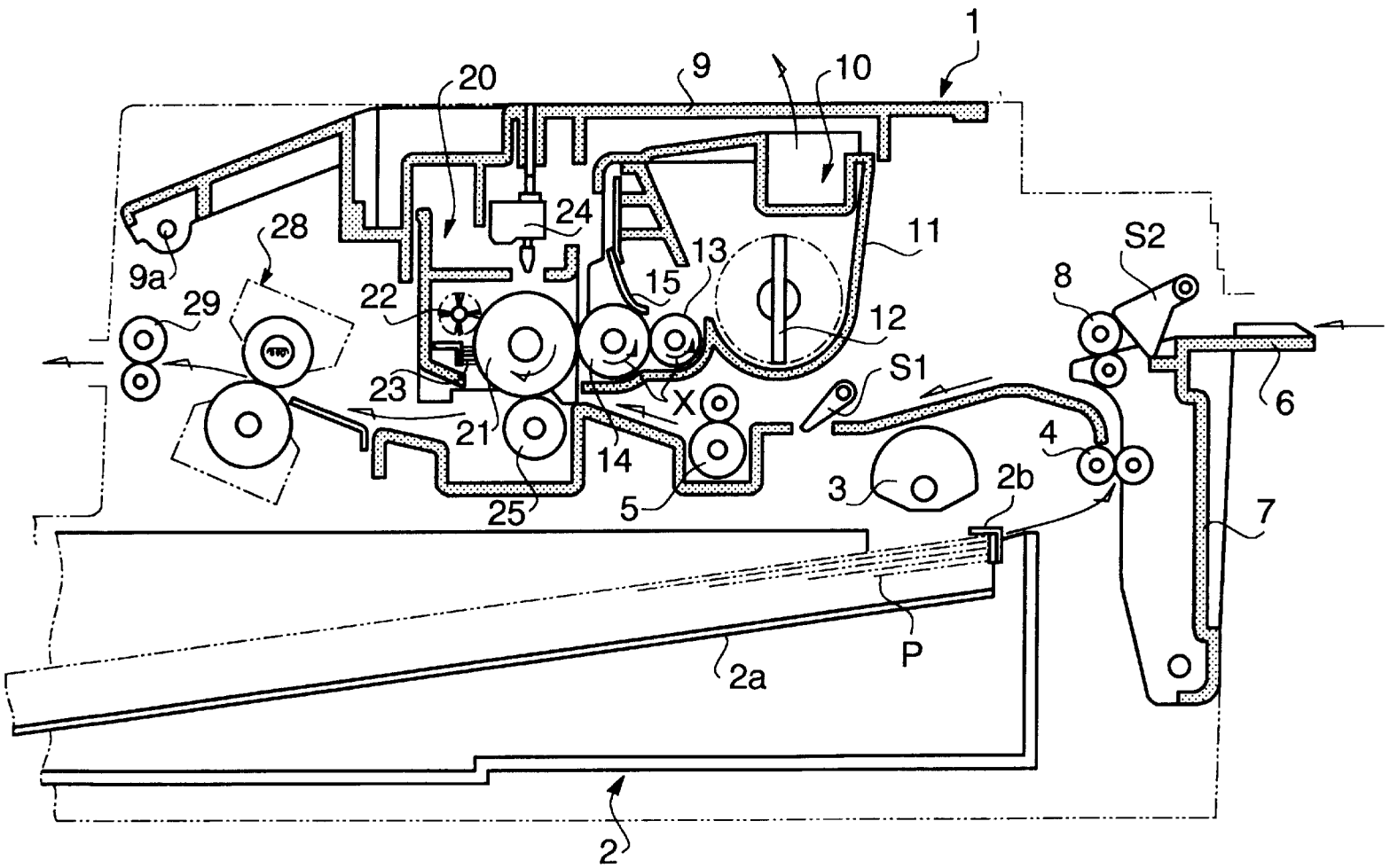
FIG. 5 is an illustrative diagram showing the composition of an image forming device to which the control unit according to the present invention can be applied.
Figure 6:
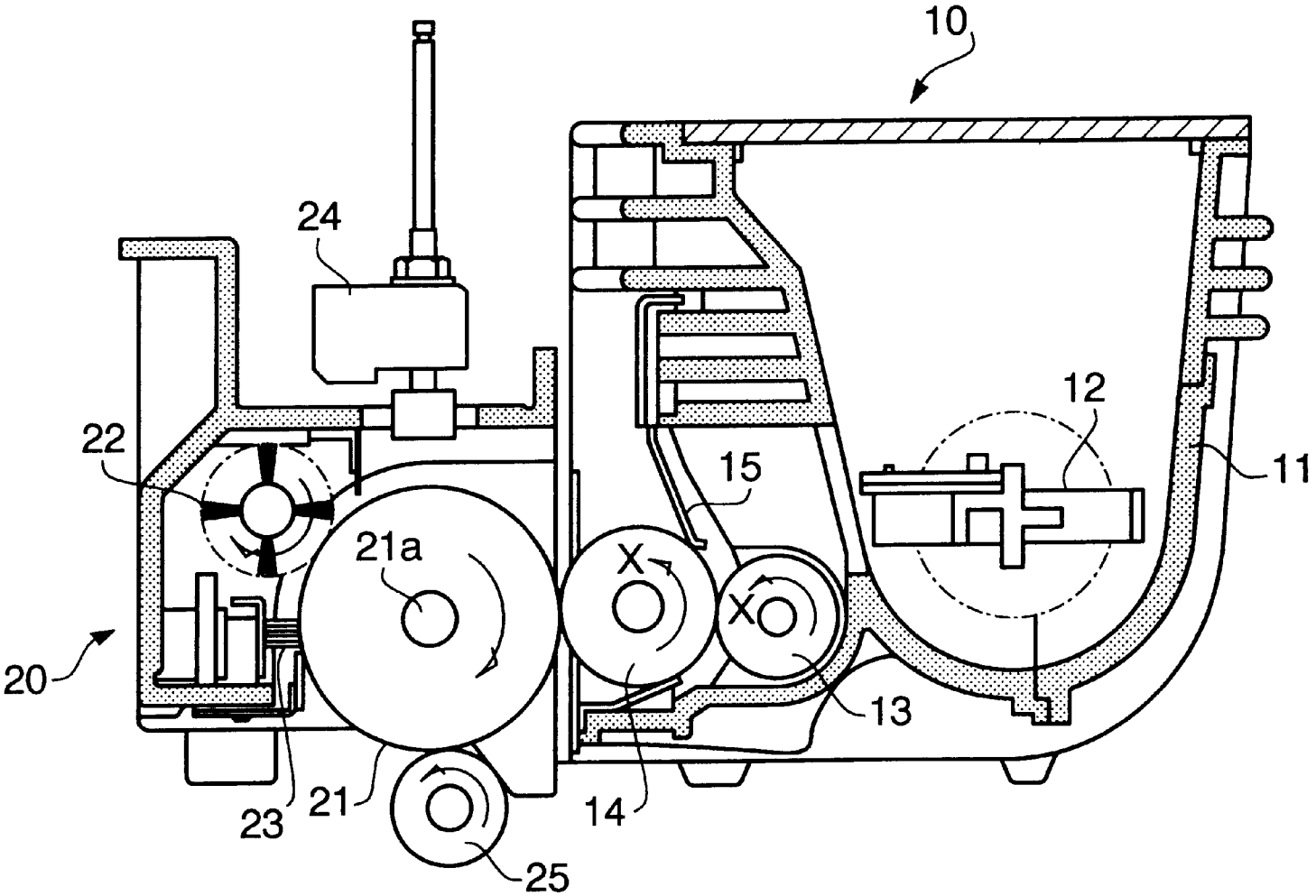
FIG. 6 is an illustrative diagram of a process unit provided in the image forming device shown in FIG. 5.

As illustrated in FIGS. 5 and 6, an image forming device having the composition described above is constituted as a cleaner-less type of image forming device which does not comprise a cleaner unit and recovers the toner remaining on the photosensitive body after image transfer and reuses it for image formation. Paper is supplied by installing a paper supply cassette 2 to the lower portion of the main body of the image forming device 1 in the illustrated embodiment. The paper supply cassette 2 comprises a bottom plate 2*a* onto which the printing paper is loaded and a separating hook 2*b* for separating sheets of printing paper. Furthermore, a pick-up roller 3 is provided in the image forming device for supplying paper from the paper supply cassette, and a semicircular roller is used for this roller 3. Feed roller units 4, 5 are positioned on the printing paper conveyance path for guiding printing paper output from the paper supply cassette 2, a fuser unit 28 is provided on the downstream side of the image transfer section constituted by the transfer roller 25, and a path for outputting copies is formed by an exit roller unit 29. When printing paper is conveyed by the feed roller unit 5 in synchronism with the toner image formed on the photosensitive drum 21, a voltage is supplied by the transfer roller 25, thereby transferring the toner image formed on the photosensitive drum onto the printing paper.

In the image forming device 1 described above, an openable side cover 7 is provided in the main body of the device in a certain region of the paper feed path, and when a paper jam, or the like, occurs in the paper feed path, the user deals with the jam by opening the guide plate, which is formed integrally with the side cover 7. A manual feed tray 6 is also provided in an opening formed in the upper portion of the side plate 7, and manual feed paper supply rollers 8 are located in a position corresponding to the paper feed path, thereby constituting a further paper feed path for conveying printing paper to the feed roller unit 5. Sensors S1, S2, and the like, for detecting printing paper are positioned in the paper feed path, in such a manner that the control unit is able to control conveyance of the printing paper in the paper feed path by using the detection information from these sensors.

In the main body of the image forming device described above, a process unit located in the upper portion of the device frame incorporates a developer unit 10 and a photosensitive body unit 20. The two units 10, 20 constituting this process unit can be removed in an upward direction, when a top cover 9 provided in the upper portion of the device main body is in an opened state via a fulcrum 9*a*. An image writing unit 24 for writing images to the photosensitive drum is provided on the top cover 9, and the writing position of the image writing unit 24 with respect to the photosensitive drum 21 is set automatically when the top cover 9 is in a closed state.

The developer unit 10 provided in the process unit comprises an agitator 12 for agitating the toner (e.g., one-component toner) inside a toner container 11, a developing roller 14 which is positioned with respect to the photosensitive drum, a supply roller 13 for charging and supplying the toner to the developing roller 14, and a blade 15 for forming the toner adhering to the surface of the developing roller 14 into a thin layer. By driving the supply roller 13 and the developing roller 14 in the same direction whilst they are pressed against each other, the toner becomes charged by friction between the two rollers, and the toner adheres to the surface of the developing roller. The toner adhering to the surface of the developing roller 14 is formed into a thin layer of uniform thickness by means of the blade 15 pressing against the toner, and the toner is exposed to the photosensitive drum 21 at the developing position.

In the photosensitive unit 20 which is incorporated with the developer unit, there are provided a photosensitive drum 21 and a charging roller 22 for applying a uniform electrical charge to the photosensitive drum. The photosensitive drum 21 is earthed to the ground connection of the main frame. A memory removing member 23 is provided in the lower portion of the frame of the photosensitive unit 20 and it performs an action of scattering the toner remaining on the photosensitive drum and weakening the adhesive force thereof.

In the process unit, the supply roller 13 provided in the developer unit 10 is constituted by an elastic roller comprising a shaft and an electrically conductive sponge-like elastic body or a brush having electrically conductive fibers of a prescribed length provided on the shaft. A voltage supply power circuit connected to the control unit illustrated in FIG. 1 supplies a bias voltage of −400−−600V, and preferably around −500V, to the shaft of the supply roller 13 by means of a contact member (not shown). The developing roller 14 is constituted by forming a metal roller shaft (e.g., made from stainless steel) and a covering of electrically conductive rubber (e.g., silicone rubber, polyurethane rubber, NBR) to a prescribed thickness on the shaft. This developing roller 14 is formed with a smooth surface. A bias voltage of −200 to −400V, and preferably around −300V, is applied to the developing roller 14, and the blade 15 associated with the developing roller 14 serves to set the thin layer of toner formed on the surface of the developing roller 14 to a uniform thickness, and it is constituted by an elastic blade consisting of a polyurethane resin sheet or a stainless steel plate member. A bias voltage in the range of −300V to −500V, and preferably around −400V, is applied to the blade 15.

The distance between the shaft of the supply roller 13 and the shaft of the developing roller 14 is set to a distance slightly smaller than the sum of the radii of the two rollers. By causing these two rollers to rotate in the same direction (direction X in the drawing), the rollers are pressing and rub against each other in opposite directions in the region of contact between the rollers. Due to the frictional action of the two rollers and the difference between the voltages applied to the respective rollers, the toner becomes charged between the two rollers and the toner adheres to the surface of the developing roller 14. Then, the toner adhering to the surface of the developing roller 14 is formed to a uniform thickness by the blade 15, and a toner image is formed by exposing this toner to the photosensitive drum and causing the toner to be transferred to a latent image formed on the photosensitive drum.

The photosensitive drum 21 and the charging roller 22, such as a brush roller, are provided in the photosensitive unit 20, which is associated with the developer unit 10. An image is written by positioning the image writing unit 24 with respect to the photosensitive drum 21, and a toner image formed on the photosensitive drum is transferred to printing paper by means of electrical discharge of the transfer roller 25. The image writing unit 24 is constituted by an LED head array, and light is irradiated onto the photosensitive drum by lighting the LEDs on the basis of information from an image information outputting device. The surface of the photosensitive drum 21 consists of an earthed photosensitive body, and it is charged to −750V by means of a charging roller 22. The electrical potential of the sections of the drum onto which light is irradiated by the image writing unit 24, in other words, the electrical potential of the section corresponding to the black parts of the image information, becomes approximately −80V, thereby generating a potential difference between the exposed areas and non-exposed areas (sections corresponding to the white parts of the image information), and hence forming an electrostatic latent image corresponding to the image information.

When the toner carrying a negative charge on the developing roller 14 comes into contact with the electrostatic latent image formed on the photosensitive drum, the toner is absorbed by the exposed areas of the surface of the photosensitive drum 21, thereby forming a toner image on the surface of the photosensitive drum (negative developing). In the transfer position of the toner image, the toner image is transferred to the printing paper by applying a bias voltage of 0.6–3.5 kV by means of the transfer roller 25 from the rear face of the printing paper. The printing paper onto which the toner image is transferred is fed to a fuser 18 by the rotation of the photosensitive drum. After the toner image has been transferred to the printing paper, the toner remaining on the surface of the photosensitive drum is scattered on the surface of the photosensitive drum by means of the charging roller 22, and it is charged to the same electrical potential as the potential of the surface of the photosensitive drum. At the position where the photosensitive drum contacts the developing roller 14, this toner is transferred to the developing roller 14 due to the potential difference between the drum and the developing roller 14, and it is mixed with the toner freshly supplied from the container and reused. Between printing sheets, a voltage of +1.6 kV is applied to the transfer roller 25 when the temperature is less than 20° C., and a voltage of +400V is applied thereto when the temperature is equal to or above 20° C.

In the image forming device 1 illustrated in FIGS. 5 and 6, the sensor may be located at an arbitrary position where it is not affected by the heat of the fuser unit, but since the transfer roller is located close to the fuser unit, it is necessary to provide the sensor in a position where it can detect change in the temperature of the transfer roller as accurately as possible. Therefore, if the sensor is positioned, for example, in the lower potion of the partition frame in the vicinity of the transfer roller, then temperature information can be obtained relatively accurately. If more accurate temperature or humidity information is to be obtained, then the sensor should be located in a position where the environmental conditions of the transfer roller can be detected accurately such as inside a photosensitive body housing.

By adopting the composition described above, the device according to the present invention can set appropriate printing conditions at the start of a job by determining an optimum transfer voltage in consideration of the environmental conditions when a printing job is started. By applying a test voltage and controlling the transfer voltage each time a prescribed number of sheets has been printed during a printing operation, it is possible to maintain uniform image quality of the printed paper, and furthermore to prevent a higher voltage than necessary from being applied to the transfer roller and photosensitive body, thereby preventing damage being caused to the photosensitive body, or the like. Moreover, when setting the transfer voltage, it is feasible to eliminate sudden voltage changes in boundary temperature regions in the control tables, thereby causing change in the control voltage with respect to temperature change to move in a smooth fashion and hence making it possible to prevent change in the image quality of the printed paper.

Furthermore, by adopting the composition described above, it is possible to adjust the voltage applied to the transfer roller to an optimum value during an operation of printing a large volume of paper, and hence it is possible to maintain uniform image quality of the printed paper. By using the voltage control means according to the present invention, there are no instances of a greater inflow current than necessary flowing to the transfer roller and the photosensitive drum, and hence in addition to suppressing deterioration of the respective members of the device, it is possible to maintain uniform image quality without significant change in the surface potential of the photosensitive body between sheets of printing paper.

The image forming devices described above are disclosed in Japanese Patent Application Nos. 10-125238 filed Apr. 20, 1998 and 10-116808 filed Apr. 27, 1998, and the entire disclosures thereof are incorporated herein by reference. The subject application claims priority of these two Japanese Patent Applications.

What is claimed is:

1. An image forming device for forming images on successively supplied printing media, comprising:

a photosensitive body;

a charging device for applying a uniform electric charge to said photosensitive body;

a writing unit for forming an electrostatic image on said photosensitive body;

a developing unit for forming a toner image over the electrostatic image on the photosensitive body;

a transfer roller for transferring a toner image to each of printing media from said photosensitive body with a transfer voltage;

a detecting circuit for detecting a current through the transfer roller when a test voltage is applied to the transfer roller when the transfer roller is in direct contact with the photosensitive body with no printing media interposed in between;

a sensor for detecting an environmental parameter affecting toner image transfer; and a control unit for adjusting said transfer voltage in accordance with the environmental parameter determined by the sensor and the current detected by the detecting circuit.

2. The image forming device according to claim 1, wherein the transfer voltage is adjusted after a prescribed number of printing media have been printed.

3. The image forming device according to claim 1, wherein the transfer voltage is adjusted by referring to a look-up table according to environmental parameter determined by said sensor.

4. The image forming device according to claim 1, wherein said environmental parameter is temperature.

5. The image forming device according to claim 1, wherein said environmental parameter is humidity.

6. The image forming device according to claim 1, wherein said environmental parameter includes temperature and humidity.

7. An image forming device comprising:

a photosensitive body;

means for applying a uniform electric charge to said photosensitive body;

means for forming an electrostatic image on said photosensitive body;

developing means for forming a toner image over the electrostatic image on said photosensitive body;

transferring means for transferring the toner image onto printing media from said photosensitive body;

means for detecting temperature;

means for applying a test voltage and detecting a current;

a plurality of voltage setting means associated with a plurality of temperature ranges respectively for determining a plurality of transfer voltages on the basis of temperature detection values and current detection values for the plurality of temperature ranges respectively; and means for harmonizing transfer voltages in boundary regions between adjacent temperature ranges.

8. The image forming device according to claim 7, wherein said plurality of voltage setting means includes at least one look-up table.

9. The image forming device according to claim 7 further including a humidity sensor for detecting humidity of the image forming device, and wherein the plurality of voltage setting means further takes in account the detected humidity when they determine the transfer voltages.

10. In an image forming device having a photosensitive body and a transfer roller for transferring images formed on the photosensitive body to printing media fed successively between the photosensitive body and the transfer roller, a control device comprising:

a sensor for detecting environmental parameters;

a detecting circuit for detecting an electrical characteristic of the transfer roller when the transfer roller is in direct contact with the photosensitive body with no printing media interposed in between; and a control unit connected to the sensor and the detecting circuit for determining a transfer voltage applied to the transfer roller based on the detected environmental parameters and electrical characteristic of the transfer roller.

11. The image forming device according to claim 10 wherein the environmental parameters include temperature and/or humidity, and wherein the control unit determines the transfer voltage by referring to a look-up table on the basis of temperature and/or humidity.

12. The device of claim 10, wherein the electrical characteristic of the transfer roller is its resistance.

13. An image forming device comprising:

a photosensitive body;

a charging device for applying a uniform electric charge to said photosensitive body;

a writing unit for forming an electrostatic image on said photosensitive body;

a developing unit for forming a toner image over the electrostatic image on said photosensitive body;

a transfer roller for transferring the toner image onto printing media from said photosensitive body with a transfer voltage;

a temperature sensor;

a detecting circuit for detecting a current through the transfer roller when a test voltage is applied to the transfer roller when the transfer roller is in direct contact with the photosensitive body; and a control unit connected to the temperature sensor and the detecting circuit for setting the transfer voltage based on the detected temperature and current in accordance with predetermined relationships between the transfer voltage and the detected current, wherein the relationship is defined for a plurality of temperature ranges, and wherein the relationships near an overlapping current region defined for two adjacent temperature ranges are harmonized.

14. In an image forming device having a photosensitive body and a transfer roller for transferring images formed on the photosensitive body to printing media, a method of controlling a transfer voltage applied to the transfer roller, comprising:

detecting an environmental parameter of the image forming device;

detecting an electrical characteristic of the transfer roller when the transfer roller is in direct contact with the photosensitive body with no printing media interposed in between; and controlling the transfer voltage based on the detected environmental parameters and electrical characteristic of the transfer roller.

15. The method of claim 14, wherein the environmental parameters include temperature and/or humidity, and wherein the electrical characteristic of the transfer roller is its resistance.

16. The method of claim 15, wherein the step of detecting the resistance of the transfer roller comprises:

applying a test voltage to the transfer roller when the transfer roller is in direct contact with the photosensitive body with no printing media interposed in between; and detecting a current through the transfer roller when the test voltage is applied.

* * * * *